US006554270B2

(12) United States Patent
Yamamoto

(10) Patent No.: US 6,554,270 B2
(45) Date of Patent: Apr. 29, 2003

(54) SHEET FEEDING APPARATUS, IMAGE READING APPARATUS AND IMAGE FORMING APPARATUS

(75) Inventor: Yuichi Yamamoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/780,421

(22) Filed: Feb. 12, 2001

(65) Prior Publication Data

US 2001/0015518 A1 Aug. 23, 2001

(30) Foreign Application Priority Data

Feb. 18, 2000 (JP) ..... 2000-040695

(51) Int. Cl.[7] ..... B65H 3/06
(52) U.S. Cl. ..... 271/117; 271/121
(58) Field of Search ..... 271/117, 118, 271/121

(56) References Cited

U.S. PATENT DOCUMENTS 4,777,498 A 10/1988 Kasamura et al. ..... 346/150
4,787,616 A 11/1988 Sasaki et al. ..... 271/3.1
4,799,084 A 1/1989 Koike et al. ..... 355/14 SH
4,934,686 A * 6/1990 Ono et al. ..... 271/117
5,462,267 A * 10/1995 Hori ..... 271/118
5,624,109 A * 4/1997 Tanaka ..... 271/118
5,868,385 A * 2/1999 Embry et al. ..... 271/118
5,882,002 A * 3/1999 Kamei et al. ..... 271/118
6,024,356 A * 2/2000 Tanaka et al. ..... 271/118
6,131,898 A 10/2000 Hiroi et al. ..... 271/10.03
6,168,147 B1 * 1/2001 Nose et al. ..... 271/118

FOREIGN PATENT DOCUMENTS

JP 405301645 A * 11/1995 ..... 271/118

* cited by examiner

*Primary Examiner*—H. Grant Skaggs
(74) *Attorney, Agent, or Firm*—Fitzpatrick, Cella, Harper & Scinto

(57) ABSTRACT

A sheet feeding apparatus having a feeding device including a feeding member for feeding a sheet from a rest stand and a support member for supporting the feeding member, in which the support member swings about a rotary shaft provided at one end of the support member to thereby move the feeding device up and down. A force applying unit provided on the rotary shaft brings the feeding member into contact with the sheet on the rest stand with a predetermined force. The predetermined force is smaller than a force due to the gravitational force of the feeding device against the sheet on the rest stand.

11 Claims, 11 Drawing Sheets

SHEET FEEDING APPARATUS, IMAGE READING APPARATUS AND IMAGE FORMING APPARATUS

BACKGROUND OF THE INVENTION

1. Field of the Invention

The present invention relates to a sheet conveying apparatus for separating and feeding sheets one by one to a predetermined position, and more particularly to a sheet conveying apparatus applicable to an image forming apparatus such as a copying machine and a laser beam printer.

2. Related Background Art

There are proposed various types of conventional sheet conveying apparatus for automatically conveying the sheet to an image reading portion of an image forming apparatus such as a copying machine, in which a plurality of sheets resting on a rest stand are separated one by one in a separating portion and conveyed to the image reading portion of the image forming apparatus, and which is provided with a means for reversing a front surface and a back surface of the sheet or the like.

A flow of the original in the separating portion in the conventional sheet conveying apparatus will now be described briefly with reference to FIGS. 6 and 7 (cross-sectional view and a view as viewed in a direction indicated by the arrow A). First of all, a stack of sheet Sa rested on a rest stand 11*a* is picked up one by one from a top portion of the sheet stack Sa by a feed means such as a feed roller 1*a* that stands by above the sheet stack Sa and is fed toward the separating means downstream thereof. A fixed guide 6*a* for smoothly guiding the sheet to the separating means is provided in a position where it does not interfere with the up-and-down movement of the feed roller 1*a* between the feeding means and the separating means.

The sheets that have been fed without being separated one by one by the feed roller 1*a* (double feed) are separated one by one by the separating means (that is composed of a separating conveying roller 3*a* and a separating pad 4*a*) located downstream of the feed roller 1*a* and conveyed to a predetermined image reading position.

The operation of the feed roller 1*a* and the separating conveying roller 3*a* will now be described.

First of all, the separating conveying roller 3*a* rotates about a shaft 5*a* in a sheet conveying direction (clockwise direction in FIG. 6) using a motor Ma as a drive source. The feed roller 1*a* is subjected to the drive transmission through a timing belt 7*a* and rotates about a shaft 13*a* in the sheet conveying direction (clockwise direction in FIG. 6) using the same motor Ma as the separating conveying roller 3*a* as a drive source. The up-and-down movement of the feed roller 1*a* is performed by means of the same motor Ma through arms 2*a* rotatable about the above-described shaft 5*a*. When the feed roller 1*a* is brought into contact with the sheet stack and a torque (pressure) equal to or more than a predetermined level in a direction in which the feed roller 1*a* presses the sheet stack is applied, a slide is generated between the shaft 5*a* and the arms 2*a* by spring clutches 12*a* each engaging between the shaft 5*a* and the arm 2*a,* to thereby interrupt the lowering motion of the feed roller 1*a* (see FIG. 12).

However, if the above-described arrangement is taken as in the conventional case, there is a fear of the generation of the following defects.

Although the fixed guide 6*a* for guiding the sheet from the feed roller 1*a* to the separating conveying roller 3*a* is provided in the position where it does not interfere with the up-and-down movement of the feed roller 1*a,* the same fixed guide could not be provided in the position (space between the arms 2*a*) where it interferes with the up-and-down movement in consideration of the swing (upward and downward movements) of the arms 2*a,* and there is a fear that the sheet could not be guided smoothly between the arms 2*a*. As a result, the sheet is brought into abdominal abutment with the separating conveying roller 3*a* (the phenomenon in which the leading end of the sheet collides against a portion other than the vicinity of the separating nip and is not led to the nip (see FIG. 11)), the leading end portion of the sheet is raised and damaged in the worst case.

In order to solve such a problem, as shown in FIGS. 8 and 9, an arrangement is proposed in which a fixed guide 14*a* (that is a discrete member from the fixed guide 6*a* but integral with the arms 2*a*) is provided between the arms 2*a* to prevent the abdominal abutment to the separating conveying roller 3*a*. However, if such an arrangement is taken, there is a disadvantage that due to the sheet feeding structure of the feed roller 1*a,* in the case where a plurality of sheets are fed toward the separating conveying roller 3*a* at once, the plurality of sheets are constrained by the guide 14*a* so that no sheet could be fed to the separating conveying roller 3*a* (non-feed). Furthermore, in order to avoid the above-described abdominal abutment and non-feed, as shown in FIG. 10, it is proposed to provide a structure in which the above-described fixed guide 14*a* is rotatable about a pivot "b" on each of the arms 2*a*. However, even in such a structure, in the case where a plurality of sheets with their leading end folded are introduced to the separating conveying roller 3*a,* there is a fear that it is brought into abdominal abutment and the guide 14*a* is forced up (in a direction indicated by an arrow in FIG. 10). This is insufficient as a countermeasure.

Moreover, in a practical point of view for shortening a processing time concomitant with the high speed operation, since the stack displacement of the sheets on the feed tray 11*a* and the stack introduction (a state where a number of sheets are introduced to the separating means in the form of a stack) are generated due to the shock upon the up-and-down movement of the feed roller 1*a* by the arms 2*a,* the up-and-down movement is not performed in many cases in the sheet feeding operation (i.e., the feed roller is always pressed to the sheet during the operation). This is the case in the above-described conventional case. Then, in the conventional structure, since the force is applied to the feed roller 1*a* in a direction in which the sheet stack is pressed to thereby keep a conveying force, the force in addition to a self-weight of the feed roller is applied to the feed roller 1*a* by the spring clutch 12*a* that is the force applying means to compensate for the conveying force. Namely, the conveying force is kept by means of the force of the spring clutch 12*a* and the gravitational force (the self-weight) of the feed roller 1*a* upon the forward drive of the motor Ma (in which the feed roller 1*a,* the separating conveying roller 3*a* and the arms 2*a* work in the direction indicated by the arrow in FIG. 6). However, upon the interruption of the drive of the motor Ma, the force which is applied to the feed roller 1*a* by the spring clutch 12*a* is released and the bias is attained only by means of the gravitational force. Accordingly, in some cases, the feed roller 1*a* is jumped up by the force of restitution of the elastic deformation of the feed roller 1*a* or the restitution force of the elastic deformation of the spring clutch that is larger than the restitution force of the feed roller 1*a* immediately after the interruption of the drive, so that the feed roller 1*a* stays in a position somewhat away from the uppermost surface of the sheet. Then, upon the next sheet feeding operation, the feed roller 1*a* is lowered again downwardly so that the shock is applied to the sheet and the stack displacement and the stack introduction into the separating means would occur. Also, in the case where the separating means is not provided, the stack introduction would occur in the conveying means downstream of the conveying portion so that there is a fear that the faulty sheet conveyance would occur.

SUMMARY OF THE INVENTION

Accordingly, in view of the foregoing problems, an object of the present invention is to stabilize the feed condition of the sheet, and more particularly to prevent the stack displacement on a rest stand and the stack introduction.

In order to attain this and other objects, a sheet feeding apparatus according to the present invention is characterized by comprising:

a rest stand for resting a sheet; and feeding means for feeding the sheet on the rest stand, in which the feeding means swings about a rotary shaft to be movable up and down, the feeding means abuts against the sheet on the rest stand by force applying means provided on the rotary shaft with a predetermined force, and a force of the force applying means is smaller than a gravitational force (self-weight) of the feeding means.

In the foregoing arrangement, since the force of the force applying means is set to be smaller than the gravitational force of the feeding means, the fine up-and-down movement of the feeding means during the feeding operation is reduced to prevent any shock, any stack displacement of the sheet on the rest stand, and the stack introduction without fail.

DESCRIPTION OF THE PREFERRED EMBODIMENTS

A sheet conveying apparatus according to an embodiment of the present invention will now be described with reference to the accompanying drawings. Incidentally, in the following embodiment, the sheet conveying apparatus in an image forming apparatus such as a copying machine or the like will be exemplified and described.

Figure 5:
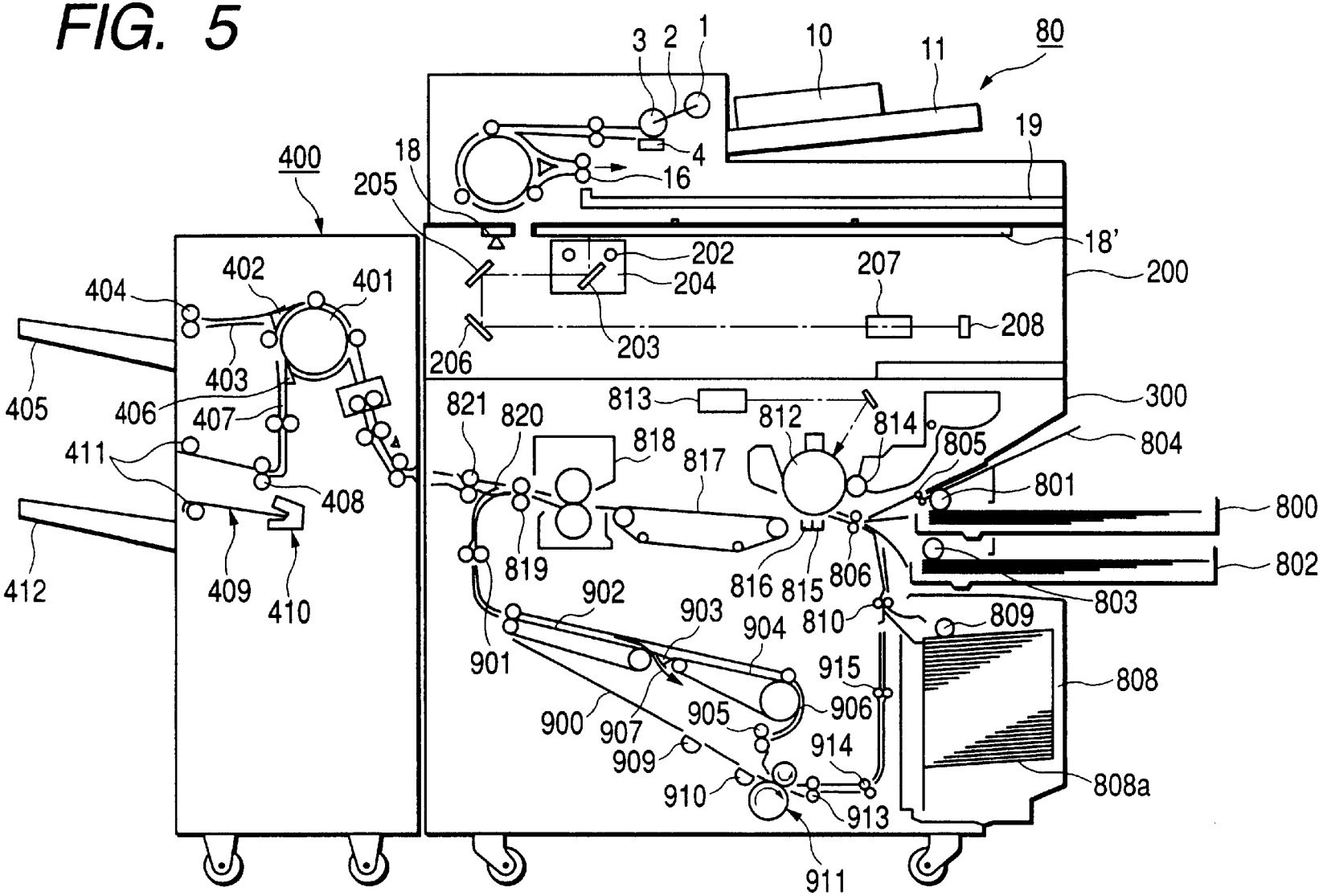
FIG. 5 is a cross-sectional view showing an image forming apparatus body to which the sheet conveying apparatus according to the present invention is applicable.
Figure 6:
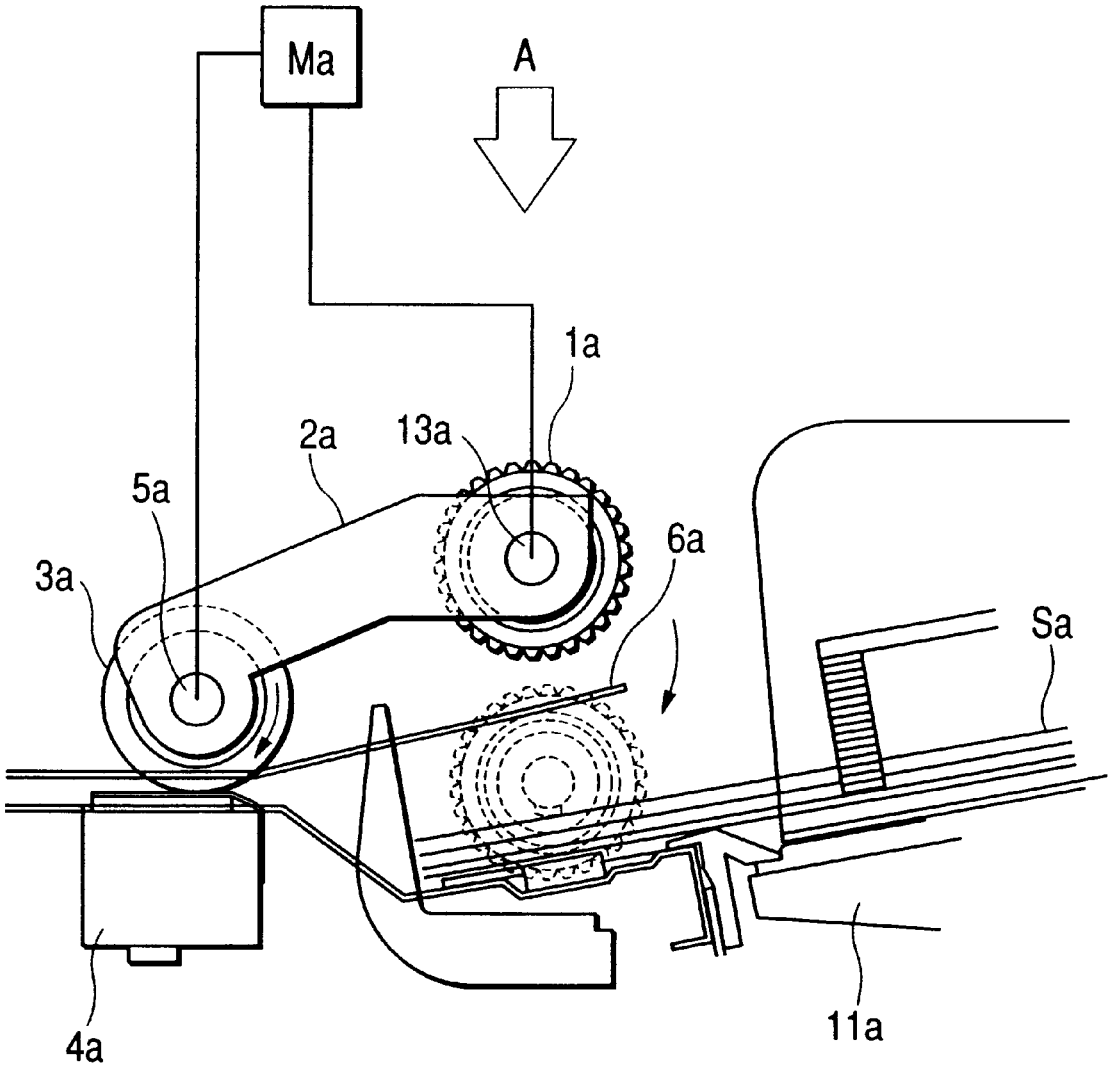
FIG. 6 is a cross-sectional view of the feed portion and the separating portion of the conventional sheet conveying apparatus.
Figure 7:
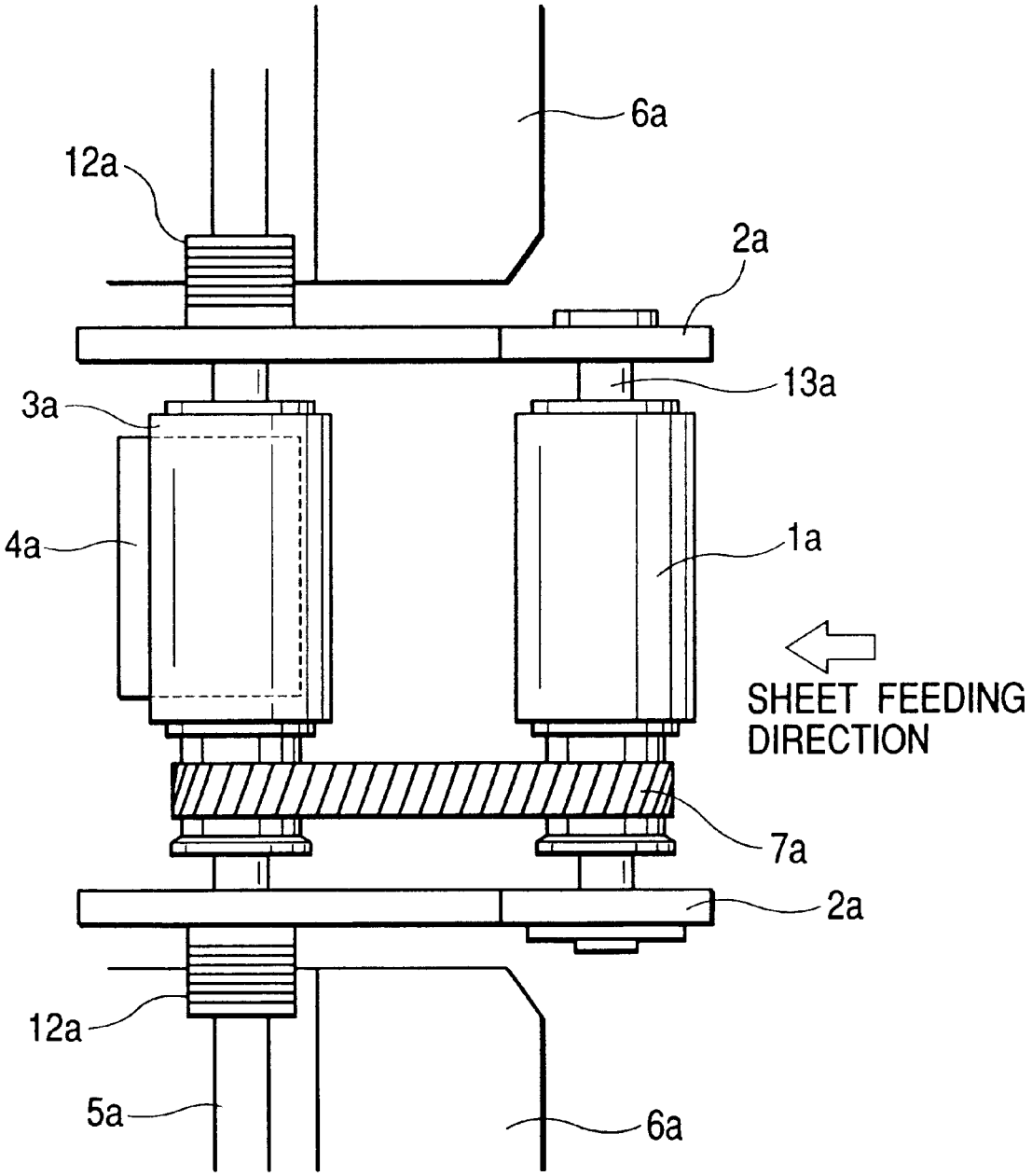
FIG. 7 is a plan view showing the feed portion and the separating portion (a view looking in a direction indicated by the arrow A in FIG. 6) of the conventional sheet conveying apparatus.
Figure 8:
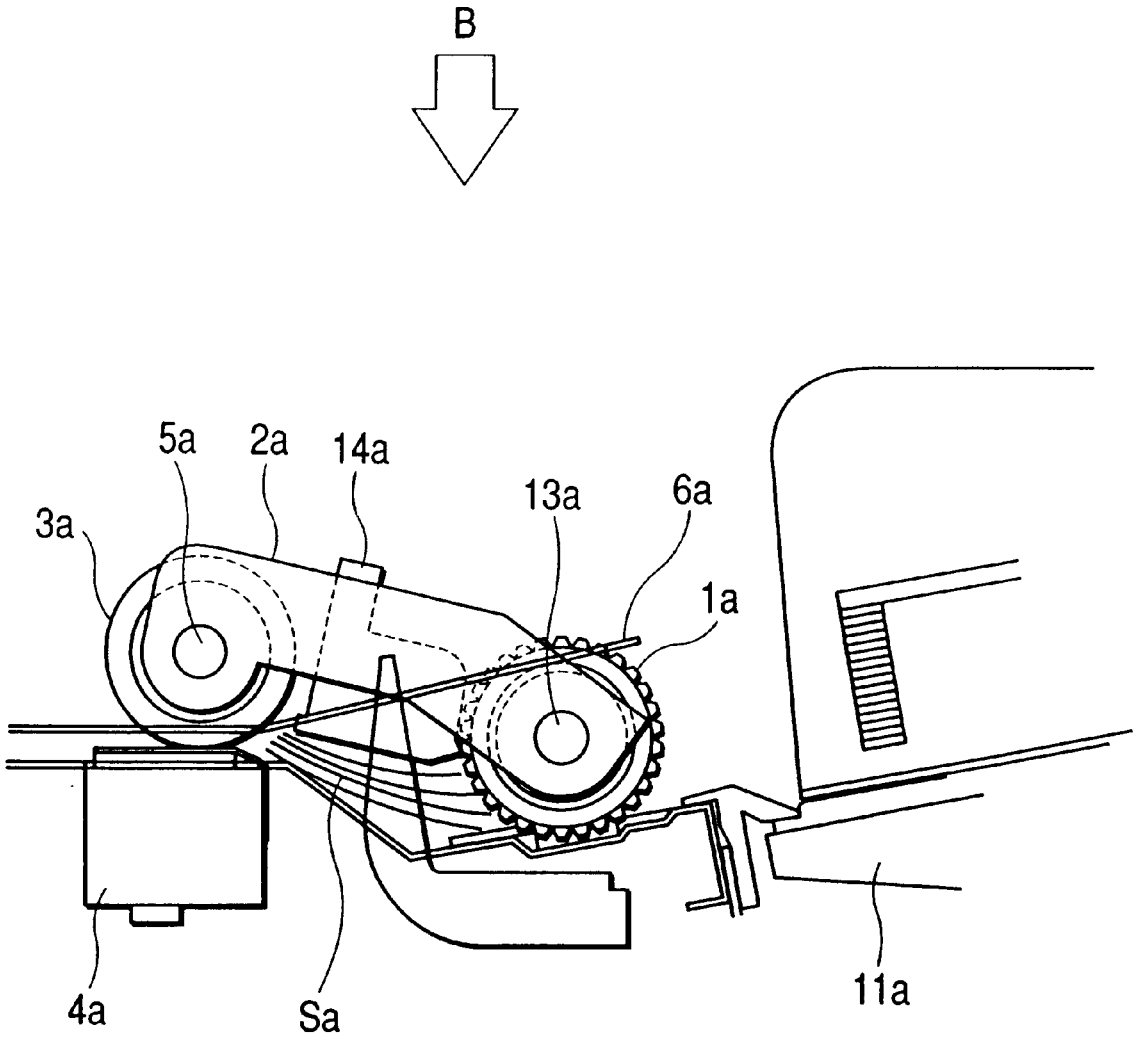
FIG. 8 is a cross-sectional view showing the feed portion and the separating portion of the conventional sheet conveying apparatus.
Figure 9:
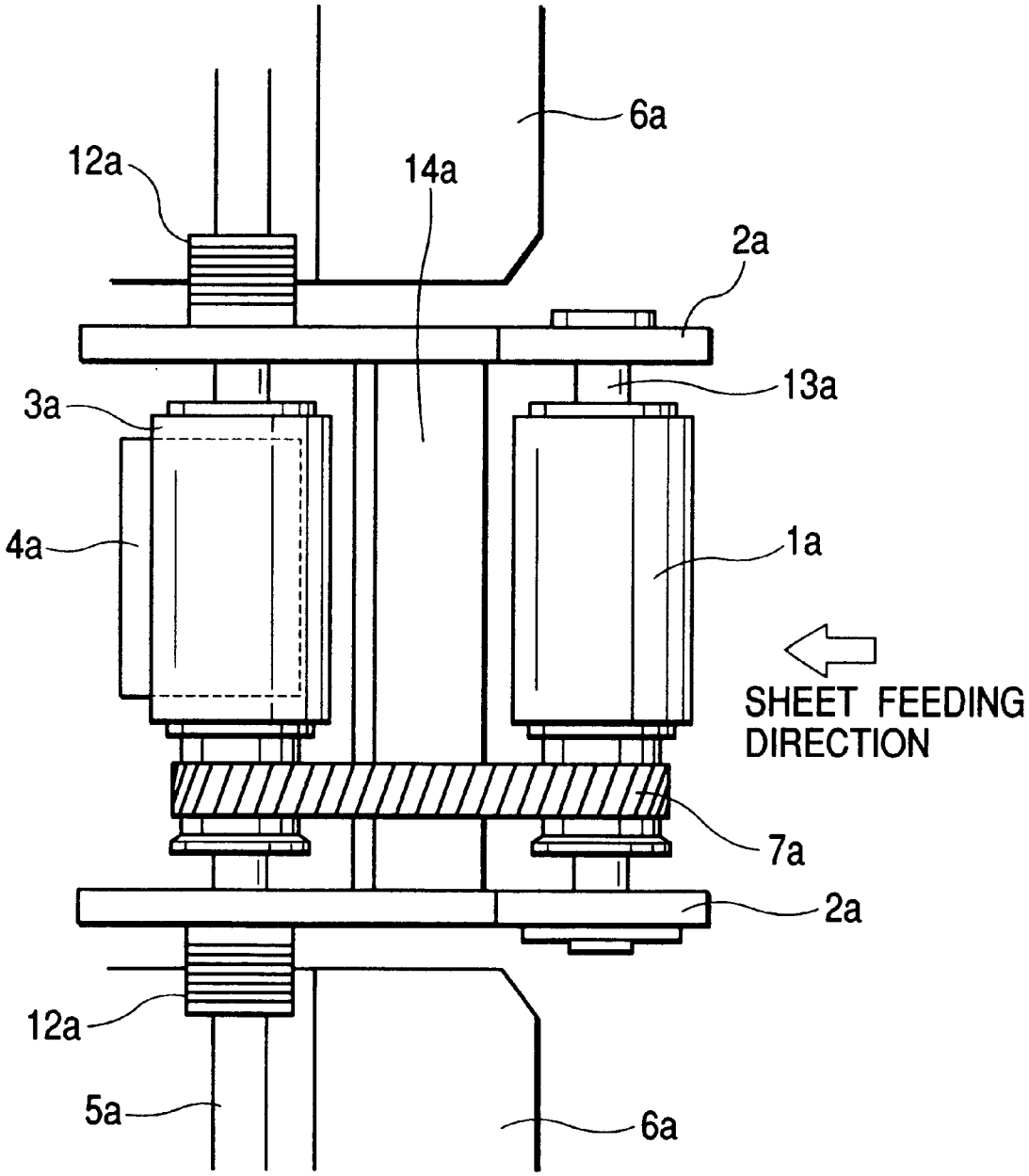
FIG. 9 is a plan view showing the feed portion and the separating portion (a view looking in a direction indicated by the arrow B in FIG. 8) of the conventional sheet conveying apparatus.
Figure 10:
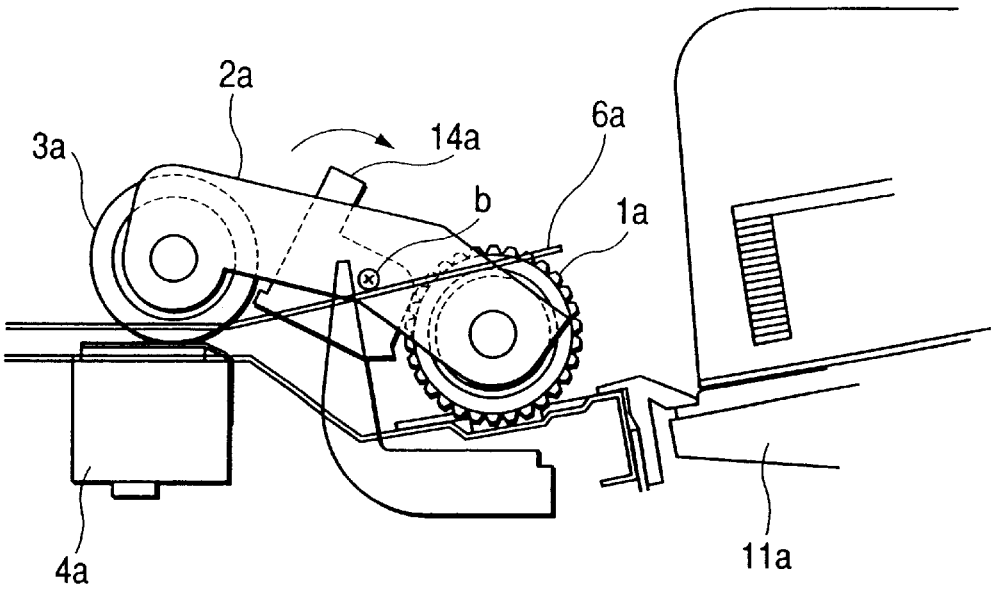
FIG. 10 is a cross-sectional view showing the feed portion and the separating portion of the conventional sheet conveying apparatus.
Figure 11:
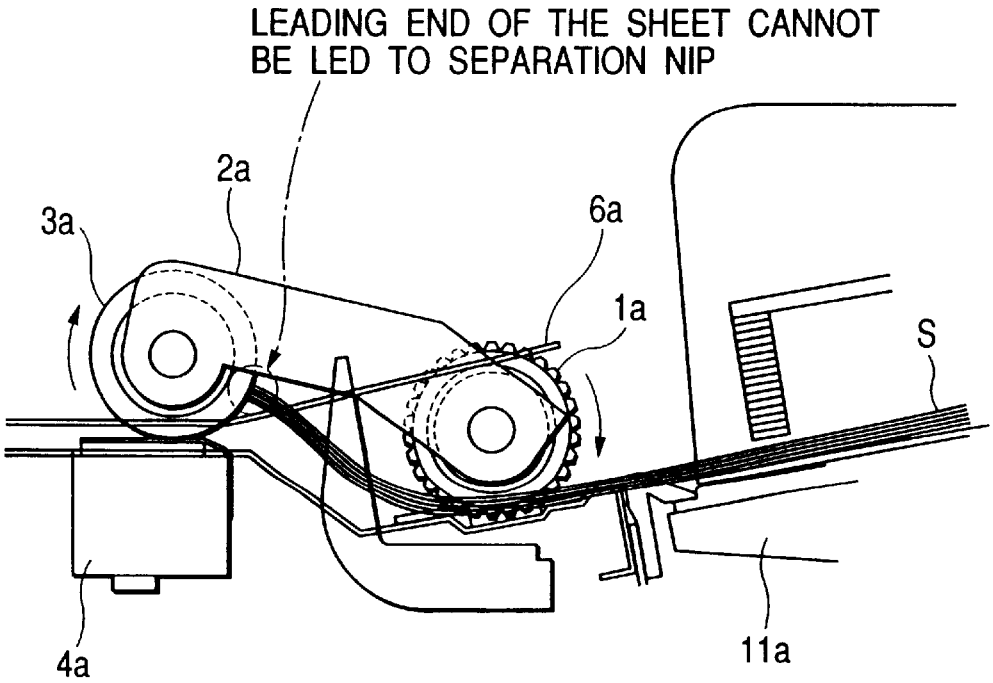
FIG. 11 is a cross-sectional view showing the feed portion and the separating portion of the conventional sheet conveying apparatus and showing an activity of an abdominal abutment of the sheet.
Figure 12:
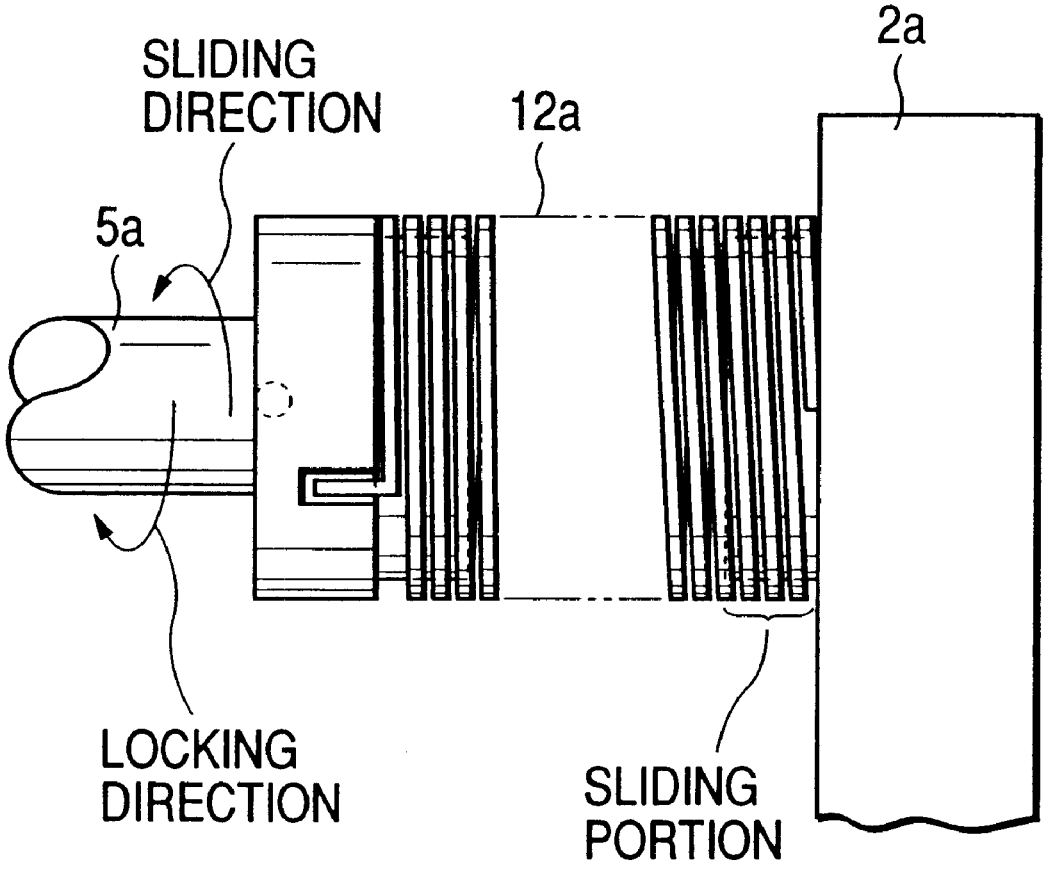
FIG. 12 is a cross-sectional view showing the feed portion and the separating portion of the conventional sheet conveying apparatus and showing a mounting state of a spring clutch.

First of all, an example of an image forming apparatus body to which the sheet conveying apparatus of the present invention may be applied will now be described with reference to FIG. 5. Incidentally, the sheet conveying apparatus according to the invention will be described later in more detail.

The sheet conveying apparatus, i.e., ADF (automatic document feeder) 80 according to the present invention has a feed tray 11 as a rest stand in an upper portion. A stack of sheets S on the feed tray 11 is fed in order from the uppermost sheet by a feed roller 1 used as a feeding member. The sheet is separated one by one by a separating conveying roller 3 and a separating pad 4 that constitute separating means and is conveyed onto a platen 18 that is an image reading position of the image forming apparatus body. Then, after reading the image, the sheet S is discharged onto a discharge tray 19 by a pair of discharge rollers 16. Incidentally, the sheet S is laid on the discharge tray 19 in the order of page one (page two), page three (page four), . . . in order from the upper side.

A copying machine body as the image forming apparatus is composed of an image input portion 200 (hereinafter referred to as a reader portion) and an image output portion 300 (hereinafter referred to as a printer portion).

The reader portion 200 optically reads out image information recorded on the sheet S that is an object to be read out such as an original or the like to photoelectrically convert the image information to input image data and has a scanner unit 204 having platens 18 and 18', a lamp 202, a mirror 203 and the like, mirrors 205 and 206, a lens 207, an image sensor 208 and the like.

The printer portion 300 that is the image output portion will now be described.

Numeral 800 denotes an upper cartridge. The sheet that is the object to be recorded such as a recording medium contained in the cartridge or the like is separated and led one by one to a pair of registration rollers 806 by the action of a separation claw and a feed roller 801. Numeral 802 denotes a lower cartridge. The sheet that is the object to be recorded within the cartridge is separated and led one by one to the pair of registration rollers 806 by the action of a separation claw and a feed roller 803. Numeral 804 denotes a manual sheet feed guide for leading the sheet one by one through a pair of rollers 805 to the registration rollers 806. Numeral 808 denotes a sheet stacking device (that is of a deck type) and is provided with an intermediate plate 808*a* that is moved up and down by a motor or the like. The sheet that is the object to be recorded on the intermediate plate 808*a* is separated one by one and led to a pair of conveying rollers 810 by the action of a feed roller 809 and a separation claw.

Numeral 812 denotes a photosensitive drum, numeral 813 denotes a reading optical system, numeral 814 denotes a developing device, numeral 815 denotes a transfer charger, and numeral 816 denotes a separation charger to thereby form the image forming means.

Numeral 817 denotes a conveying belt for conveying the sheet on which the image has been formed. Numeral 818 denotes a fixing device, numeral 819 denotes a pair of conveying rollers, and numeral 820 denotes a flapper. The sheet on which the image has been formed is led to a pair of body discharge rollers 821 by the flapper 820 and discharged to a sheet treating apparatus 400 downstream thereof.

With respect to one sheet that has been read on the platen (i.e., the sheet that is the object to be read, such as the original), the images in correspondence with the set number of copies are formed on the photosensitive drum 812. Sheets corresponding to the number of copies (i.e., the sheet that is the object for recording, such as the recording medium) are fed from any one of the cartridges 800 and 802 and the deck 808 every time the image is formed on the photosensitive drum 812. The registration between the image on the photosensitive drum 812 and the sheet that is the object for recording is performed by the registration rollers 806.

Numeral 900 denotes an intermediate tray for stocking once the sheet on which the image has been formed in the case where the images are formed on two sides of the sheet that is the object for recording, or in the case where the images are formed while being overlapped (superimposed) on one side of the sheet that is the object for recording. Numeral 901 denotes a pair of conveying rollers, numeral 902 denotes a conveying belt, numeral 903 denotes a flapper, numeral 904 denotes a conveying belt and numeral 905 denotes a pair of conveying rollers. For the two-sided copy, the sheet is led to the intermediate tray 900 through a path 906, and for the multi-copy, the sheet is led to the intermediate tray through a path indicated by an arrow 907.

The sheets stacked on the intermediate tray 900 are separated one by one from the lower side of the stack and re-fed by a pair of reverse/forward rotation separation rollers 911 and assist rollers 909 and 910. The sheet that has been re-fed is led to the image forming portion through the conveying rollers 913, 914, 915 and 810 and the registration rollers 806. After the image formation, the sheet is discharged in the same manner as described above.

With respect to one sheet of which the image has been read on the platen, first of all, the copying operations on one sides of the sheets (the sheets that are the objects for recording, such as the recording medium) in correspondence with the set number of copies are performed. These sheets are stacked on the intermediate tray 900. Thereafter, the front surface and the back surface of the sheet that is the object to be read out are reversed within the ADF 80 and the sheet is led again into the reading portion (platen 18) to read out the image information. The image (image information) that has been read out is formed on the sheets to be recorded which are re-fed from the intermediate tray 900.

The sheet that has been subjected to the image formation and that is to be discharged from the copying machine body is discharged to the sheet treating apparatus 400 (also referred to as a finisher).

The sheet that has been conveyed from the copying machine body is discharged and laid onto a sample tray 405 through a buffer roller 401, a flapper 402, and a non-sort mode path 403 by discharge rollers 404 in case of the non-sort mode. Also, in the sort mode, the sheet is discharged and temporarily laid on a treating tray 409 as the intermediate tray by a pair of discharge rollers 408 through the buffer roller 401, a flapper 406 and a sort mode path 407. Both end portions, intersecting the sheet conveying direction, of the stack of sheets on the treating tray 409 are aligned by an alignment member (not shown), and discharged and laid on a stack tray 412 by a pair of stack discharge rollers 411 after the trailing end portion of the sheet stack has been processed by a stapler 410 if necessary.

The sheet conveying apparatus (ADF 80) according to the present invention will now be described in more detail with reference to FIGS. 1 to 4.

Figure 1:
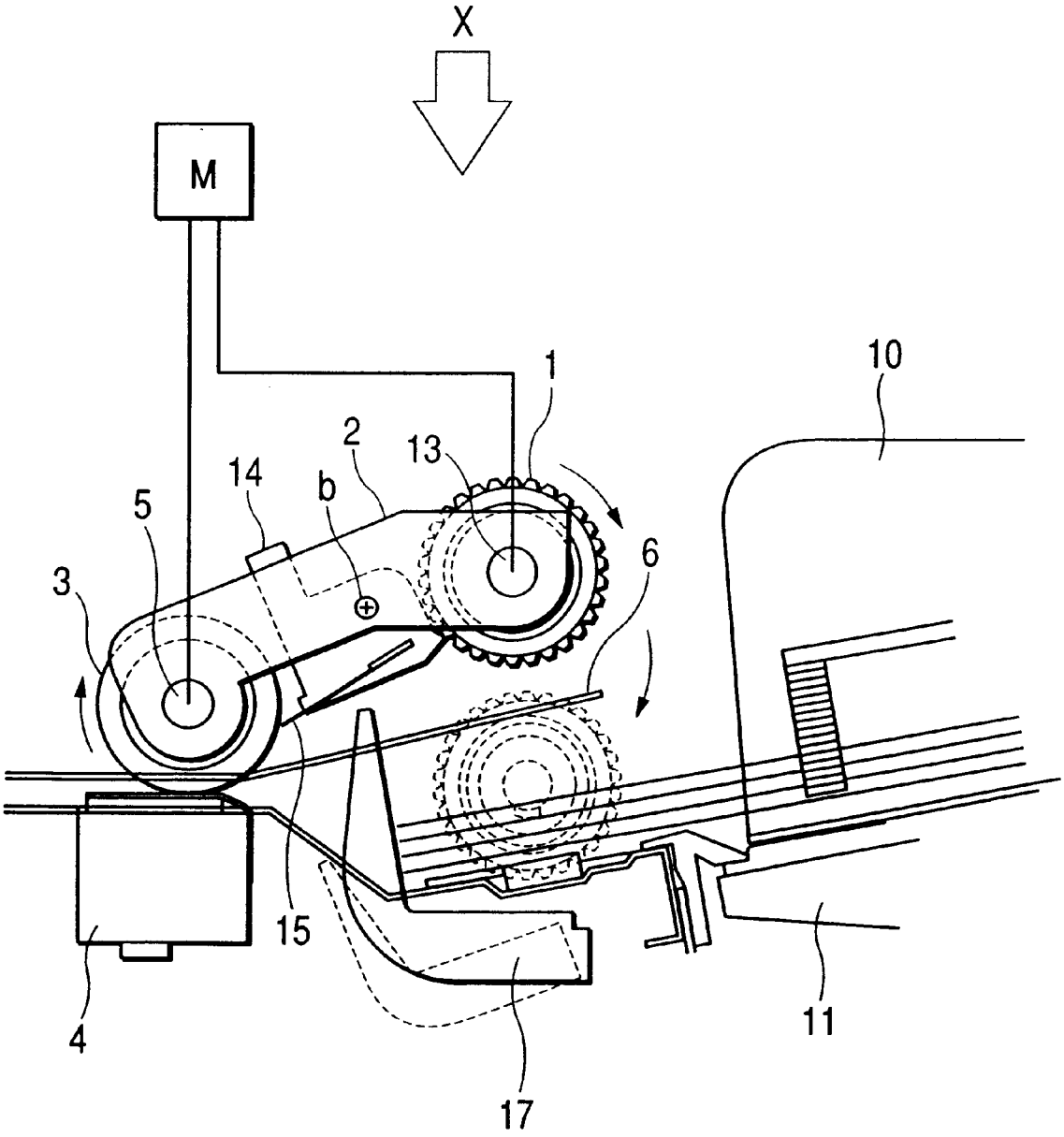
FIG. 1 is a cross-sectional view of a feed portion and a separating portion of a sheet conveying apparatus according to the present invention.
Figure 2:
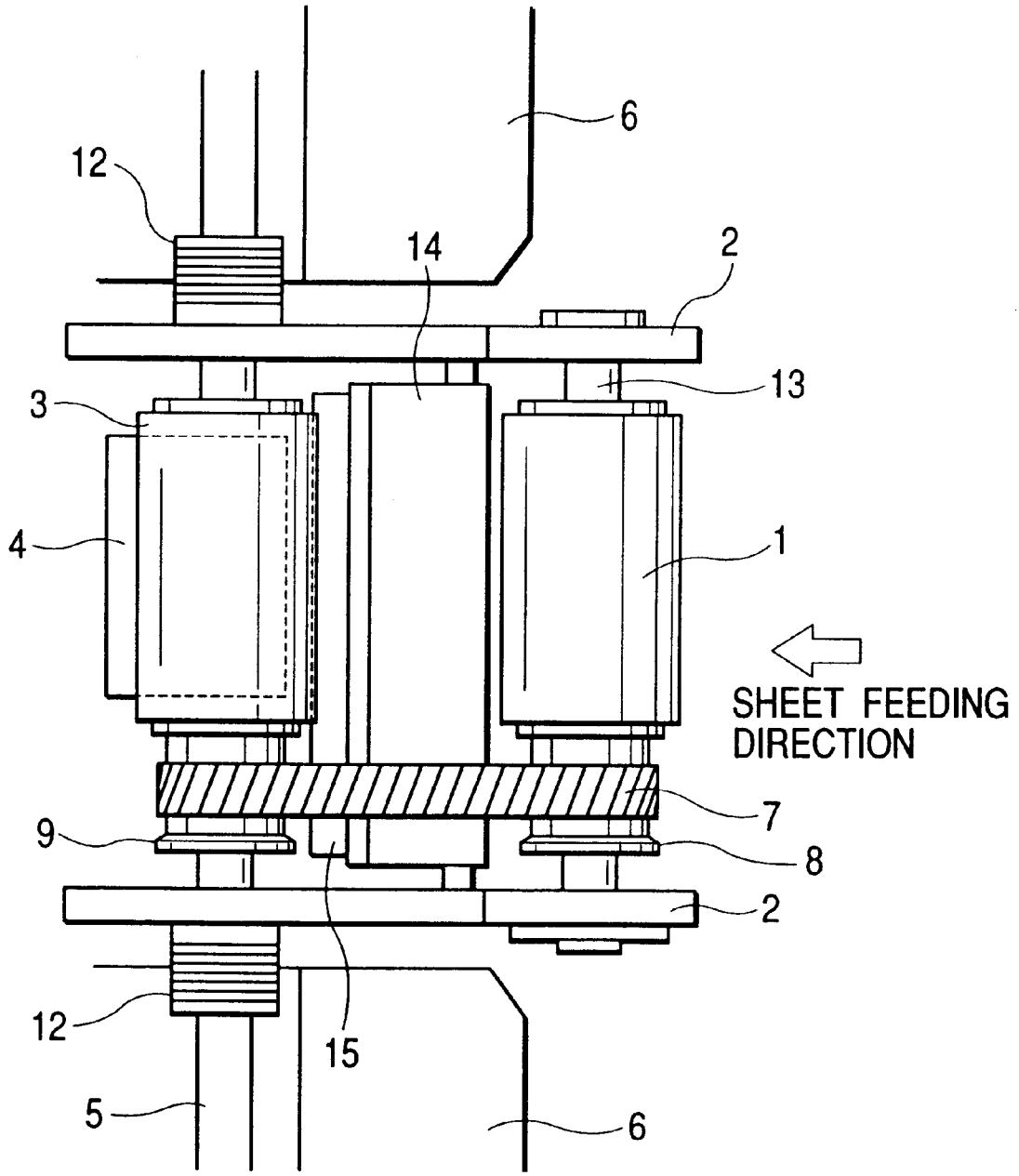
FIG. 2 is a plan view showing the feed portion and the separating portion (a view looking in a direction indicated by the arrow X in FIG. 1) of the sheet conveying apparatus according to the invention.

In FIGS. 1 and 2, numeral 1 denotes a feed roller as the feed member, numeral 2 denotes an arm that is a support member for rotating (moving up and down) the feed roller 1 about the shaft 5, numerals 3 and 4 denote a separating conveying roller and a separating pad constituting a separating means for separating sheets one by one, numeral 6 denotes a fixed guide for smoothly guiding the sheet from the feed means to the separating means, numeral 7 denotes a timing belt for transmitting a drive of a motor M to the feed means, numerals 8 and 9 denote pulleys around which the timing belt 7 is extended, numeral 11 denotes a feed tray as a rest stand for setting the sheet that is the object to be read out such as an original, and numeral 10 denotes a sheet width regulating plate for regulating the width of the sheet that is the object to be read out and that is set on the feed tray 11.

Also, numeral 12 denotes a spring clutch used as a force applying means for imparting a predetermined force (torque) after the feed roller 1 is brought into contact with the top surface of the sheet on the feed tray 11 in forward rotation of the motor M (in which the feed roller 1 and the separating conveying roller 3 are rotated in the direction indicated by the arrows and the arm 2 is moved downwardly in FIG. 1), and for locking in order to raise the arm 2 in reverse rotation (opposite to the direction indicated by the arrows).

Numeral 13 denotes a shaft that serves as a rotational pivot for the feed roller 1. Reference numeral 14 denotes a swing guide for serving as guide means and for guiding the sheet from the feed roller 1 to the separating conveying roller 3, which is constituted to be pivotally movable about a pivot "b". Numeral 15 denotes an elastic member such as a mylar that may be elastically deformed, mounted at a tip end portion (on the downstream side) of the swing guide 14 corresponding to a sheet contact portion. Numeral 17 denotes a stopper for the sheet.

The stack of sheet, which is the object to be read out, laid on the feed tray 11 is conveyed from the uppermost portion of the sheet to the separating means composed of the separating conveying roller 3 and the separating pad 4 by the feed roller 1 and separated one by one in the separating means in the case where a plurality of sheets are conveyed. Then, the one sheet separated by the separating means is conveyed to the image reading means on the downstream side (on the platen 18 that is the image reading position of the reader portion 200) and after the image readout, is discharged to the discharge tray 19 by the discharge rollers 16.

The sheet feeding operation will now be described including the feature of the motion of the swing guide 14 having the elastic member 15 such as mylar at the tip end portion corresponding to the sheet contact portion.

First of all, the stack of sheet laid on the feed tray 11 is detected by a sensor (not shown) to be ready for the process (operation). A copy start key (not shown) is depressed by the user to start the process (operation). Then, the sheet stopper 17 is lowered (from the solid line to the dotted line) by a solenoid (not shown) or the like. The motor M is driven in the forward direction (i.e., the direction in which the feed roller 1, the separating conveying roller 3 and the arm 2 are rotated in the directions indicated by the arrows in FIG. 1). The driving torque of the motor M is transmitted to the shaft 5 through a gear (not shown), the timing belt or the like so that the shaft 5 is rotated in the direction indicated by the arrow in FIG. 1 so that the separating conveying roller 3 rotates to simultaneously lower the arm 2 through the spring clutch 12. When the arm 2 is lowered so that the feed roller 1 is brought into contact with the uppermost sheet on the feed tray 11 (see FIG. 3) and a predetermined force (torque) P2 is applied, the spring clutch 12 between the arm 2 and the shaft 5 starts to slide. Then, according to the further rotation of the motor M, only the uppermost sheet is guided to the separating means by the fixed guide 6 and the swing guide 14 by the rotation of the feed roller 1 and the separating conveying roller 3, so that the single sheet is separated by the separating means. Thereafter, the separated sheet that is the object to be read out is drawn out of the separating means by the roller that is rotated by the reverse drive of the motor M and conveys the sheet (which roller is located downstream of the separating portion). Upon the reverse rotation of the motor M, the electromagnetic clutch (not shown) is turned off so that the reverse driving torque is not transmitted to the shaft 5. Then, the sheet drawn out of the separating means is conveyed to the image reading means (onto the platen 18 that is the image reading position of the reader portion 200) disposed further on the downstream side by the roller and the like.

Figure 3:
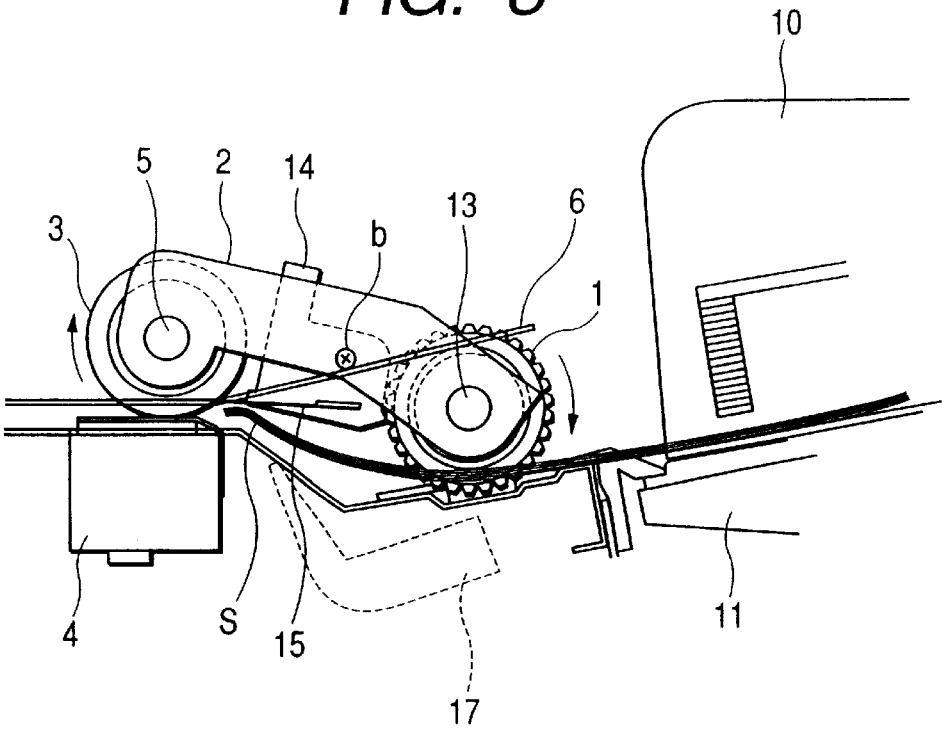
FIG. 3 is a cross-sectional view showing the feed portion and the separating portion (when the feeding means is lowered) of the sheet conveying apparatus according to the invention.
Figure 4:
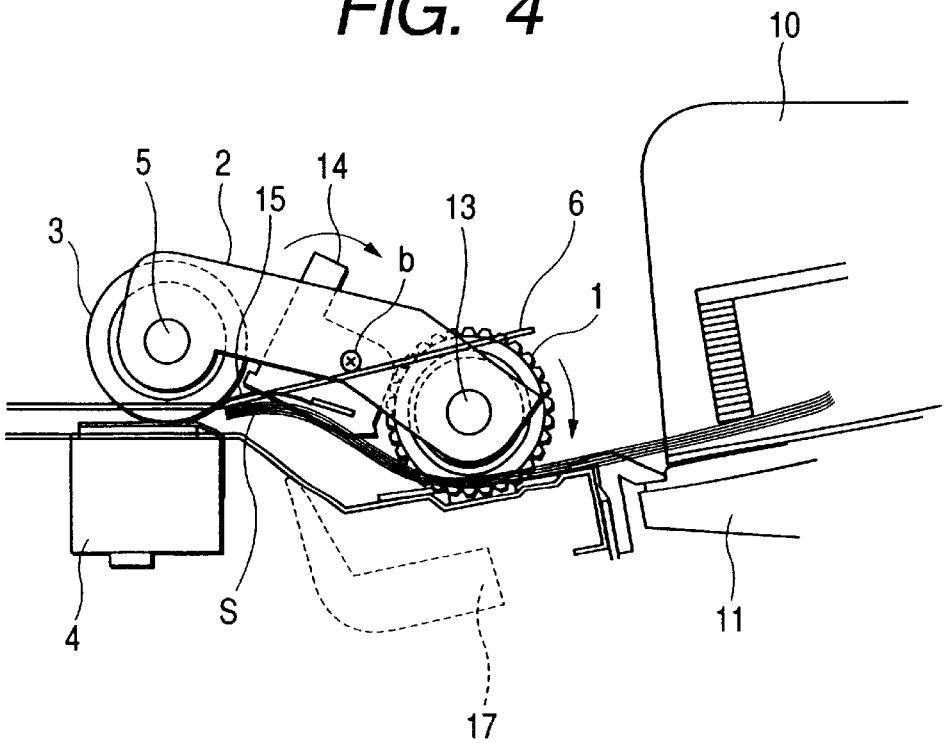
FIG. 4 is a cross-sectional view showing the feed portion and the separating portion (when a swing guide has been swung) of the sheet conveying apparatus according to the invention.

Here, the movement of the swing guide 14 and the elastic member 15 under the condition that the sheet that is the object to be read out on the feed tray 11 has been folded upwardly, or in the case where the stack of a plurality of sheets has been conveyed will now be described with reference to FIGS. 3 and 4.

When the sheet S kept under the above-described condition has been introduced or brought into contact with the swing guide 14, the swing guide 14 is retracted upwardly (in the direction indicated by the arrow in FIG. 4) about the pivot "b" between the arms 2. Thus, it is possible to prevent the non-feed of the sheet in the case where the sheet is fed under the stack state described in conjunction with the conventional example. The elastic member 15 mounted at the tip end portion of the swing guide 14 is fixed at one end to the swing guide 14 by an adhesive double coated tape or the like with the other end free. When the swing guide 14 is retracted as described above, the free end portion is brought into contact with the separating conveying roller 3 and bent as shown in FIG. 4. Namely, the elastic member 15 is elastically deformed so as to lead the sheet S that is the object to be read out to the separating means. Thus, since the above-described elastic member (mylar) 15 serves as a guide for leading the sheet to the separating means even if the swing guide 14 is retracted as described above, it is possible to prevent the abdominal abutment of the sheet S to the separating conveying roller 3.

The structure relating to the feature for preventing the stack introduction to the separating means or the stack displacement of sheets on the feed tray 11 will now be described.

First of all, in the drawings (FIG. 3 and FIG. 4) showing the state that the spring clutch 12 slides and the sheet is conveyed to the separating conveying roller 3 after the feed roller 1 is brought into contact with the top surface of the sheets on the feed tray 11, the conveying force F to be given to the sheet is represented by the product ($\mu \times P$) of the friction coefficient $\mu$ of the feed roller 1 and the force P applied to the top surface of the sheets. Then, the force P is represented by the sum of the gravitational force P1 of the feed roller 1 and the force P2 of the force applying means (the spring clutch 12 in the present embodiment). Namely, $F=\mu\times(P1+P2)$. In this embodiment, the gravitational force P1 of the feed roller 1 and the force P2 of the spring clutch 12 are set so that the force P2 of the spring clutch 12 is smaller than the gravitational force P1 of the feed roller 1 ($P1>P2$). More specifically, for instance, the gravitational force P1 of the feed roller 1 is set at 686 mN (70 gf) and the force P2 of the spring clutch 12 is set at 588 mN (60 gf) so that the gravitational force of the feed roller 1 is greater to thereby reduce the jump-up of the feed roller 1 from the top surface of the sheets on a changeover between a forward and a reverse drivings of the motor M (on a stop of a forward rotation) by the force of restitution of the feed roller 1 and the force of restitution of the elastic deformation of the spring clutch 12 that is greater than the restitution force of the elastic deformation of the feed roller 1. Since, in general, the force of restitution of the elastic deformation of the feed roller is sufficiently smaller than the force of restitution of the elastic deformation of the spring clutch, if the feed roller 1 has the gravitational force enough to suppress the restitution force of the spring clutch, it is possible to effectively prevent the jump-up of the feed roller. With such an arrangement, it is possible to prevent the stack displacement of sheets on the feed tray 11 or the stack introduction to the separating means when the next sheet is to be fed.

Incidentally, in the foregoing embodiment, the case where the gravitational force P1 of the feed roller 1 is set at 686 mN (70 gf) and the force P2 of the spring clutch 12 is set at 588 mN (60 gf) is exemplified. However, the present invention is not limited to this specific example. It is sufficient to appropriately set the gravitational force P1 of the feed roller 1 and the force P2 of the spring clutch 12 so that the force P2 is smaller than the gravitational force P1.

Figure 13:
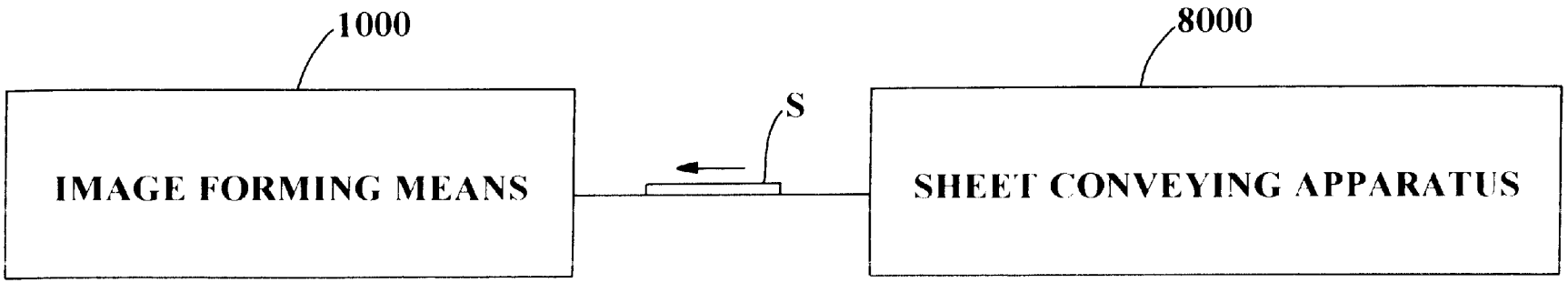
FIG. 13 is a diagram of another embodiment of the invention.

In the embodiment, the sheet conveying apparatus for feeding the sheet that is the object to be read out such as the original to the image reading means has been exemplified and described. However, the present invention is not limited thereto or thereby. For example, as shown in FIG. 13 the present invention may be applied effectively to the sheet conveying apparatus 8000 for feeding the sheets that is the object to be recorded such as the recording medium to the image forming means 1000.

Furthermore, the sheet conveying apparatus having the above-described structure is used not for either one of the above-described image reading means and the above-described image forming means but for both to thereby insure the same effect.

Also, in the embodiment, the copying machine is exemplified as the image forming apparatus. However, the invention is not limited thereto or thereby but may be applied to other image forming apparatuses such as a scanner, a printer, a facsimile machine or the like. The above-described sheet conveying apparatus is used as the sheet feeding means in the image forming apparatus to ensure the like effect.

What is claimed is:

1. A sheet feeding apparatus comprising:

a rest stand for setting a sheet; and a feeder for feeding the sheet from said rest stand, wherein said feeder swings about a rotary shaft to be movable up and down by a motor, said feeder abuts against the sheet on said rest stand with a predetermined normal force by force applying means provided on the rotary shaft, and upon disengaging the motor a force of the force applying means is smaller than a self-weight of said feeder.

2. A sheet feeding apparatus according to claim 1, wherein said feeder includes a feeding member abutting against the sheet for feeding the sheet and a support member for supporting said feeding member.

3. A sheet feeding apparatus according to claim 2, further comprising separating means for separating the sheet fed by said feeder, wherein said separating means has at least one roller member that is rotatable, and a rotary shaft of said roller member is used in common with the rotary shaft of said feeder.

4. A sheet feeding apparatus according to claim 1, wherein the motor transmits a drive force to said rotary shaft so that the drive force of the motor is transmitted from said rotary shaft through said force applying means to said feeder.

5. A sheet feeding apparatus according to claim 4, wherein said force applying means has a spring clutch provided between said feeder and the rotary shaft, and the spring clutch starts to slide when the force becomes the predetermined force.

6. A sheet feeding apparatus comprising:

a rest stand for setting a sheet; and a feeder for feeding the sheet from said rest stand, wherein said feeder includes a feeding member abutting against the sheet for feeding the sheet and a support member for supporting said feeding member, said feeder swings about a rotary shaft provided at one end of said support member to be movable up and down, said feeder abuts against the sheet on said rest stand with a predetermined force by force applying means provided on the rotary shaft, and the predetermined force is smaller than a force due to a self-weight of said feeder against the sheet on said rest stand.

7. A sheet feeding apparatus according to claim 6, further comprising separating means for separating the sheet fed by said feeder, wherein said separating means has at least one roller member that is rotatable, and a rotary shaft of said roller member is used in common with the rotary shaft of said feeder.

8. A sheet feeding apparatus according to claim 6, wherein drive means for moving said feeder up and down transmits a drive force to said rotary shaft so that the drive force of said drive means is transmitted from said rotary shaft through the force applying means to said feeder.

9. A sheet feeding apparatus according to claim 8, wherein the force applying means has a spring clutch provided between said feeder and the rotary shaft, and the spring clutch starts to slide when the force becomes said predetermined force.

10. An image reading apparatus, comprising:

a sheet feeding apparatus according to any one of claims 1 to 9 for feeding a sheet having image information; and reading means for reading the image information of the sheet that has been fed by said sheet feeding apparatus.

11. An image forming apparatus, comprising:

a sheet feeding apparatus according to any one of claims 1 to 9 for feeding a sheet; and image forming means for forming an image on the sheet that has been fed by said sheet feeding apparatus.

* * * * *

UNITED STATES PATENT AND TRADEMARK OFFICE

CERTIFICATE OF CORRECTION

PATENT NO. : 6,554,270 B2
DATED : April 29, 2003
INVENTOR(S) : Yuichi Yamamoto

It is certified that error appears in the above-identified patent and that said Letters Patent is hereby corrected as shown below:

Title page,
Item [56], References Cited, FOREIGN PATENT DOCUMENTS, "4053011645 11/1995" should read -- 5-301645 11/1993 --.

Column 1,
Line 27, "sheet" should read -- sheets --.

Column 8,
Line 49, "is" should read -- are --.

Signed and Sealed this

Twenty-third Day of December, 2003

JAMES E. ROGAN
*Director of the United States Patent and Trademark Office*